United States Patent [19]

Dömland et al.

[11] 4,147,145

[45] Apr. 3, 1979

[54] IGNITION COIL CURRENT CONTROL CIRCUIT

[75] Inventors: Christoph Dömland, Wolfsburg; Manfred Lotzmann, Gifhorn, all of Fed. Rep. of Germany

[73] Assignee: Volkswagenwerk Aktiengesellschaft, Fed. Rep. of Germany

[21] Appl. No.: 697,684

[22] Filed: Jun. 18, 1976

[30] Foreign Application Priority Data

Jun. 21, 1975 [DE] Fed. Rep. of Germany ..... 2527725

[51] Int. Cl.[2] ..... F02B 1/02; H05B 37/02

[52] U.S. Cl. ..... 123/148 E; 315/209 T

[58] Field of Search ..... 123/148 E

[56] References Cited

U.S. PATENT DOCUMENTS

| | | | |
|---|---|---|---|
| 3,871,347 | 3/1975 | Weber | 123/148 E |
| 3,884,208 | 5/1975 | Beuter | 123/148 E |
| 3,900,017 | 8/1975 | Collins | 123/148 E |
| 3,901,205 | 8/1975 | Brungsberg | 123/148 E |
| 3,924,595 | 12/1975 | Brungsberg | 123/148 E |

*Primary Examiner*—Samuel W. Engle
*Assistant Examiner*—Thomas H. Webb
*Attorney, Agent, or Firm*—Brumbaugh, Graves, Donohue & Raymond

[57] ABSTRACT

A circuit for controlling the current supplied to an ignition coil is usable in conjunction with an electronic ignition. In one embodiment a transistor is connected in shunt with the input of a current amplifier and has a control electrode connected to a voltage divider a portion of which is in series with the coil, so that the transistor is responsive to both battery voltage and coil current. Excessive voltage or coil current causes the transistor to conduct thereby lowering the input signal to the current amplifier and reducing the coil current.

6 Claims, 1 Drawing Figure

IGNITION COIL CURRENT CONTROL CIRCUIT

BACKGROUND OF THE INVENTION

This invention relates to electronic ignition circuits particularly those used in motor vehicles, and particularly to control circuits for preventing excessive coil current.

In a vehicle equipped with an electronic ignition circuit the current supplied to the ignition coil depends to a large measure upon the voltage of the vehicle battery. The battery voltage is subject to considerable fluctuation both as a result of temperature variations and as a result of the condition of battery charge. In order to provide sufficient current through the ignition coil when battery voltage is in a low state, the coil circuit must be designed with sufficiently low resistance to provide the minimum current necessary to effect proper ignition. When the vehicle battery is fully charged, and the ambient temperature is high, the battery will deliver a larger than necessary current to the ignition coil on account of higher battery voltage. The higher current through the ignition coil may result in overheating of the coil with possible coil damage.

Published German patent application No. 2,303,087 discloses a circuit arrangement for controlling current supplied to the ignition coil. This prior arrangement makes use of a circuit which is responsive to the current through the ignition coil, which is measured by the use of a resistance in series with the coil. This prior art circuit enables a considerable reduction in coil current variations, but cannot provide substantially complete compensation since the control circuit is activated by the coil current itself.

It is therefore an object of the present invention to provide a new and improved control circuit for controlling the current through an ignition coil.

It is a further object of the present invention to provide such a control circuit which is responsive to both coil current and battery voltage.

SUMMARY OF THE INVENTION

In accordance with the present invention there is provided a control circuit, usable with an ignition coil and a battery for controlling current supplied to the coil by the battery. The circuit includes means, responsive to voltage of the battery and responsive to coil current, for developing a control signal. There is also provided means responsive to the control signal for controlling the current.

In accordance with a preferred embodiment of the invention the means for developing a control signal includes a voltage divider connected to the battery and including a plurality of resistors, at least one of which is connected in series with the coil. A transistor is provided with a control electrode connected to the voltage divider. The resistors in the voltage divider have values selected so that the transistor conducts only when the current exceeds a selected value. The current control means may typically comprise a current amplifier with the transistor of the control signal developing means connected in shunt with the amplifier input. The circuit is advantageously used with a low resistance ignition coil, which insures an adequate coil current even when battery voltage is below its nominal value. In such a case use of the control circuit prevents excess current and overheating of the coil.

For a better understanding of the present invention together with other and further objects thereof, reference is made to the following description taken in conjunction with the accompanying drawing, and its scope will be pointed out in the appended claims.

DESCRIPTION OF THE INVENTION

Figure 1:
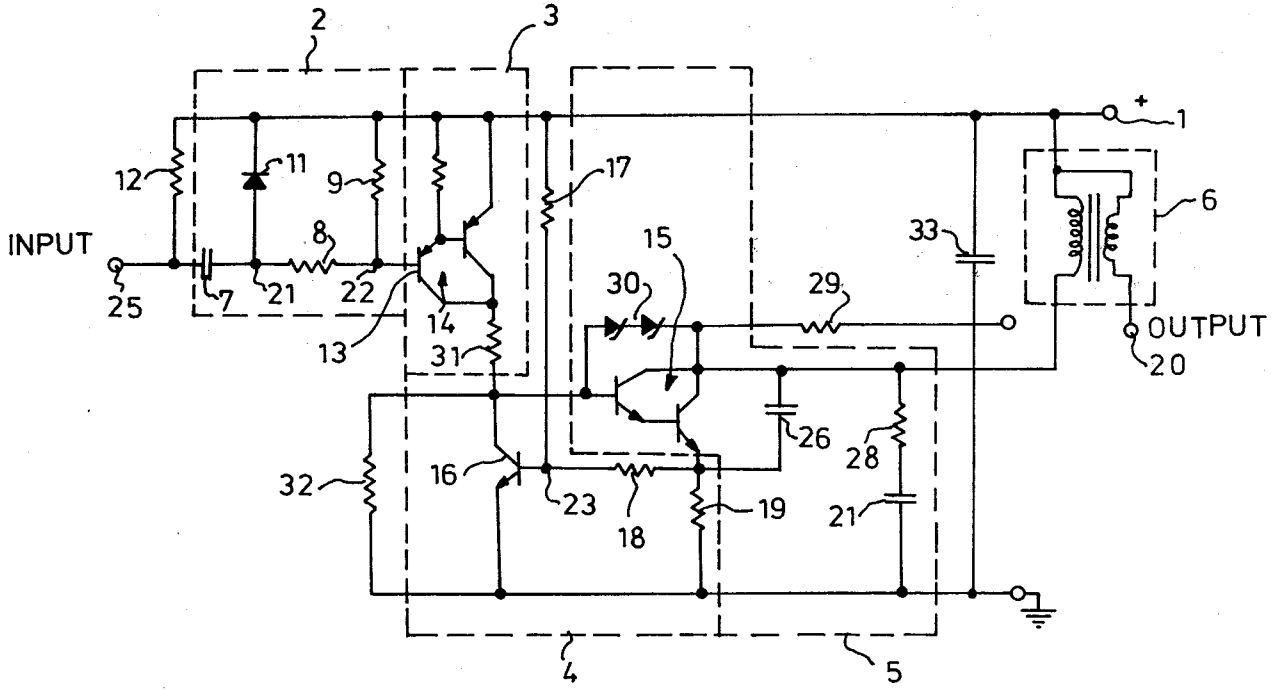
FIG. 1 is a schematic diagram of an electronic ignition system which includes a control circuit in accordance with the present invention.

FIG. 1 shows an electronic ignition circuit which includes a control circuit in accordance with the present invention. The circuit illustrated in FIG. 1 includes five major functional circuits which are separated by dotted lines. The circuit portion indicated at 2 comprises an input circuit and provides shut-off of the coil current in the event the engine is stopped with the ignition on and points closed. Circuit portion 3 constitutes a driver circuit which converts the pulse signals from the input circuit into signals suitable for use by the power stage 5. The ignition coil, including primary and secondary winding is illustrated at 6 while the control circuit of the present invention is indicated by 4.

In the illustrated embodiment the positive terminal of the vehicle battery is connected to terminal 1 of the circuit when the ignition switch is closed. The circuit is connected to the breaker points or other pulse supplying device at input terminal 25. Closing of the breaker points grounds terminal 25 of the circuit. Terminal 20 of coil 6 is a high voltage output and is connected by way of the distributor to the spark plugs of the engine.

Input circuit 2 provides a control signal for transistor 13 of Darlington pair 14 of driver circuit 3. During normal operation upon closing of the breaker points transistor 13 becomes conducting and capacitor 7 starts to charge by way of resistors 8 and 9. This charging causes the potential of terminals 21 and 22 having before a voltage near 0 Volt to rise, but transistor 13 and Darlington pair 14 of driver 3 remain conducting thereby supplying positive voltage to the control electrode of Darlington pair 15 in the current amplifying power stage 5. The current supplied to amplifier 15 is determined mainly by the value selected for resistor 31. Resistor 32 grounds the control electrode of Darlington pair 15 when pair 15 is non-conducting. When the breaker points open capacitor 7 discharges over diode 11 and the voltage at point 22 rapidly rises and causes driver stage 3 to be turned off, thereby turning off current amplifier 15.

The input circuit 2 provides protection against lasting coil current in the event the engine is stopped with the ignition switch on and points closed. In this event capacitor 7 reaches full charge at which time points 21 and 22 have a voltage equal to the battery voltage, thereby turning off driver 3 and consequently current amplifier 15.

Power stage 5 is provided with capacitors 26 and 27 and resistor 28 for protecting amplifier 15 from voltage overloads when current through coil 6 is shut off. Via resistor 29 impulses can be led to a rpm-measuring unit. Double diodes 30 are provided to limit (in connection with amplifier 15) voltage peaks which could be dangerous for amplifier 15. Capacitor 33 is provided to suppress voltage impulses in the battery circuit.

In accordance with the present invention there is provided transistor 16 which is arranged in shunt across the input of current amplifier 15. The control electrode of transistor 16 is connected to a voltage divider comprising resistors 17, 18 and 19. Resistor 19 is connected in series with the primary winding of coil 6 and current amplifier 15 and thereby carries the full coil current. Resistors 17 and 18 are also in series with resistor 19, but are parallel to coil 6. The voltage developed at terminal 23, which is connected to the control electrode of transistor 16, is dependent upon the battery voltage, by reason of the voltage divider comprising resistors 17, 18 and 19, and is additionally dependent on the coil current, since the voltage drop across resistor 19 is a function of the coil current.

The values selected for resistor 17, 18 and 19 determine the value of coil current and battery voltage combination at which transistor 16 starts to conduct. When transistor 16 conducts, it effectively shorts resistor 32 and lowers the input voltage to amplifier 15, causing a reduction in the current through amplifier 15 and coil 6. Those skilled in the art will recognize that since the control voltage is dependent on battery voltage as well as coil current it is possible to have a relatively flat region of coil current as a function of battery voltage and it is possible to select resistors 17, 18 and 19 such that coil current decreases as battery voltage is increased.

Typical values for resistors 17, 18 and 19 are 820 ohms, 10 ohms, and 0.075 ohms, respectively.

The present invention is suitable for use with a low impedance coil. Such a coil will reach operating current when supplied with battery voltages well below the expected minimum value. Excessive coil current, which would normally occur by the use of a low impedance coil, is prevented by the active current control circuit. A low impedance ignition coil, as is known from the prior art, can be realized by weakening the coupling between the primary and secondary coil windings. This results in an increase of the frequency of the leakage resonance to a range above that of the parallel resonance. The leakage resonance is determined by the combined leakage inductance of the primary and secondary windings in series and by the capacitance of the two windings. A resonance step up may be achieved by the use of flat coils, which achieve a better formation of the leakage field than the typical elongated cylindrical coils.

While there has been described what is believed to be the preferred embodiment of the present invention, those skilled in the art will recognize that other and further modifications may be had thereto without departing from the true spirit of the invention, and it is intended to cover all such embodiments which fall within the true scope of the invention.

We claim:

1. In a control circuit, usable with an ignition coil and a battery, for controlling current supplied to the coil by the battery, the improvement comprising:

means, responsive to voltage of the battery and responsive to said current, for developing a control signal, said control signal developing means including a passive voltage divider, connected across the battery and consisting of a plurality of resistors, at least one of which is circuit connected in series with the coil, and a transistor having a control electrode connected to said voltage divider, and means responsive to said control signal, for controlling said current.

2. A control circuit as specified in claim 1, wherein said at least one resistor is connected in an active series circuit with the coil.

3. A control circuit as specified in claim 1 wherein said current control means comprises a current amplifier and wherein said transistor is connected in shunt with the input of said current amplifier.

4. A control circuit as specified in claim 1, wherein said circuit includes an ignition coil having a low impedance primary, thereby to insure that said current reaches said selected value, even when said voltage is below the normal range of the battery.

5. In a control circuit, usable with an ignition coil and a battery, for controlling current supplied to the coil by the battery, the improvement comprising:

means, responsive to voltage of the battery and responsive to said current, for developing a control signal, said control signal developing means including a passive voltage divider connected across the battery and comprising at least three series connected resistors having first and second intermediate terminals, at least one of said resistors being circuit connected in series with the coil by said first intermediate terminal, and a transistor having a control electrode connected to said second intermediate terminal; and means, responsive to said control signal for controlling said current.

6. The control circuit specified in claim 1 wherein said transistor is so connected in said circuit and the resistance of said resistors is such as to cause said transistor to conduct when said current exceeds a selected magnitude.

* * * * *